United States Patent [19]

Tyler et al.

[11] 4,038,068

[45] July 26, 1977

[54] METHOD OF MELTING COPPER ALLOYS WITH A FLUX

[75] Inventors: Derek E. Tyler, Cheshire, Conn.; David W. Dickinson, Hinckley, Ohio; James E. Dore, Ballwin, Mo.

[73] Assignee: Olin Corporation, New Haven, Conn.

[21] Appl. No.: 659,241

[22] Filed: Feb. 19, 1976

[51] Int. Cl.[2] ..... C22B 15/00; C22B 9/00; C22C 9/01

[52] U.S. Cl. ..... 75/76; 75/93 AD; 75/257; 75/162

[58] Field of Search ..... 75/135, 162, 153, 76, 75/94, 96, 93 AD, 65 R; 148/23, 24, 26

[56] References Cited

U.S. PATENT DOCUMENTS

| | | | |
|---|---|---|---|
| 446,351 | 2/1891 | Jeancon | 75/162 |
| 2,944,890 | 7/1960 | Klement | 75/162 |
| 3,754,897 | 8/1973 | Derham | 148/26 |
| 3,958,979 | 5/1976 | Valdo | 75/135 |

OTHER PUBLICATIONS

Levin, E. et al., *Phase Diagrams...*, (KCl-NaCl), Columbus, 1964, FIG. 1258.

Lyman, T. (Ed.), *Metals Handbook*, vol. 2, Cleveland (ASM) 1964, p. 59.

*Primary Examiner*—Walter R. Satterfield

*Attorney, Agent, or Firm*—Robert H. Bachman; Robert A. Dawson

[57] ABSTRACT

Improved method for melting copper base alloys containing from 2 to 12% aluminum including the steps of covering a molten mass of said copper base alloy with an essentially continuous flux layer of a molten salt consisting essentially of from 10 to 90% by weight of potassium chloride, from 10 to 90% by weight of sodium chloride and less than 5% by weight of other materials, said salt having a melting point of from 660 to 800° C, and adding additional amounts of said alloy through said flux layer.

11 Claims, No Drawings

METHOD OF MELTING COPPER ALLOYS WITH A FLUX

BACKGROUND OF THE INVENTION

The present invention relates to an improved method for melting copper base alloys containing from 2 to 12% aluminum. Essentially the method utilizes a molten flux layer to aid the melting process through the provision of melt protection. The method of the present invention results in ease of feeding additional amounts of said copper base alloy into the melt and minimization of dross formation. The molten salt cover consists essentially of a mixture of potassium and sodium chloride, with the composition of the cover being such that its melting point, fluidity, and chemical activity is consistent with the melting characteristics of the alloy in question.

It is established practice in the industry to melt copper and copper base alloys under a carbonaceous cover. The covers predominantly used in the industry consist of charcoal, graphite or lampblack either singly or in combination. These covers are essentially inert with respect to normal furnace refractories, provide protection to the molten bath from excessive oxidation during the melting procedure, and prevent excessive heat losses from the melt surface. In addition, dependent upon the choice of cover, some control may be obtained of interstitial impurities, such as carbon, oxygen and hydrogen.

The foregoing covers have attained wide spread use in the melting of a full range of copper base alloys. However, the use of these covers is associated with numerous disadvantages primarily related to the entrainment of these particulate carbonaceous covers with drosses generated during melting. The entrainment of these drosses is particularly evident in those alloys containing reducing elements, especially aluminum, which forms tenacious oxide films. Characteristically, aluminum oxides wet and entrain any particulate matter, thereby accentuating the formation of dross-cover agglomerates. The mechanical interaction of the cover with the drosses generated during melting impairs the feeding of the incoming alloy charge into the molten bath. Hence, as the melting proceeds, the process becomes increasingly inefficient realizing high melt losses and long melt down times. Moreover, metal frequently becomes entrained within the dross-cover mixtures such that the drosses removed subsequent to melting may contain very large amounts of metal which represents a significant metal loss. When preparing alloy from virgin stock, the foregoing necessitates provision of additional charge to compensate for anticipated low recoveries.

Salt covers have been proposed for a variety of alloys such as those proposed in U.S. Pat. No. 3,823,013, U.S. Pat. No. 3,754,897, East German Pat. No. 15,426 and French Pat. No. 1,197,190. These procedures are generally associated with numerous disadvantages, such as the inclusion of substantial amounts of additional components which increase the cost of the salt flux and the complexity thereof.

Accordingly, there is a need to provide an inexpensive and efficient method for melting copper base alloys utilizing an inexpensive flux material which will provide significantly improved performance characteristics. It is important to recognize that such improvements should not be obtained at the expense of either accelerated deterioration of furnace refractories, or be associated with significantly increased cost. Therefore, there is a significant commercial need for providing a relatively inexpensive method for melting aluminum containing copper base alloys which is readily useable commercially and which offers significant technical improvements and also which renders improved melting performance without attack on furnace refractories.

Accordingly, it is a principal object of the present invention to provide an improved method for melting copper base alloys containing from 2 to 12% aluminum.

It is a further object of the present invention to provide an improved method as aforesaid which is inexpensive and convenient to utilize and which renders improved melting performance without attack on furnace refractories.

Further objects and advantages of the present invention will appear hereinbelow.

SUMMARY OF THE INVENTION

In accordance with the present invention it has now been found that an improved method for melting copper base alloys containing from 2 to 12% aluminum may be provided overcoming the foregoing art disadvantages. In accordance with the present invention, a molten mass of copper base alloy is provided consisting essentially of from 2 to 12% aluminum, balance copper. The molten mass is covered with an essentially continuous flux layer of a molten salt consisting essentially of from 10 to 90% by weight of potassium chloride, from 10 to 90% by weight of sodium chloride and less than 5% by weight of other materials, the salt having a melting point of from 660°to 800° C. Additional amounts of said copper base alloy are added to the melt through the flux layer. In a preferred embodiment of the present invention, a heel of said molten metal mass is provided, with the heel covered with the molten salt flux cover, and additional amounts of said copper alloy are added to the heel through the molten salt cover.

DETAILED DESCRIPTION

The present invention relates to melting copper base alloys containing from 2 to 12% aluminum, particularly those containing from 2 to 9.5% aluminum, balance essentially copper. Naturally, the alloys processed in accordance with the present invention may contain amounts of additional materials added in order to obtain particularly desirable results. Thus, the process of the present invention is applicable to copper base alloys including up to 30% zinc, up to 10% nickel, up to 15% manganese, up to 3% silicon, and a grain refining element selected from the group containing iron from 0.001 to 5.0%, chromium from 0.001 to 1%, zirconium from 0.001 to 1.0%, cobalt from 0.001 to 5.0%, and mixtures the foregoing additives may be employed. Alloys particularly suitable for use in the process of the present invention include CDA Alloy 638 and CDA Alloy 688. Naturally, other additives and impurities may be present depending upon the particular alloy in question.

In accordance with the present invention, a flux layer of molten salt is provided consisting essentially of from 10 to 90% by weight of potassium chloride and from 10 to 90% by weight of sodium chloride, and preferably from 30 to 70% of each of these materials. These salts are readily available commercially at a reasonable cost and are readily applied in solid form, much the same as conventional carbonaceous covers. These salts may be readily melted forming a liquid layer over the charge. In accordance with the present invention, it is preferred to provide a small amount or heel of molten metal which may be covered by this layer of molten salt, as when melting in channel induction furnaces. Alternatively, the salt material may be initially melted and the copper base alloy material melted under said initial molten salt, as in a gas or oil fired crucible furnace. A third alternative is to melt the salt with the initial metal charge, as in coreless induction furnaces, or gas or oil fired crucible furnaces. Subsequent melting may proceed by the passage of the incoming solid metal charge through the salt layer into the molten alloy bath.

In accordance with the process of the present invention, it has been found that the foregoing significantly improves the capability of a commercial operation to melt aluminum containing copper base alloys compared to conventional procedures. This improvement arises from several features, including a reduction in the amount of dross generated, an accelerated melt down cycle and a substantially improved molten metal cleanliness. All of these features are due to the particular characteristics of the salt used in the process of the present invention and the procedure of the process of the present invention. Thus, for example, the presence of the essentially continous flux layer between an amount of molten alloy, as a molten alloy heel, and the alloy charge provides a thermally insulating barrier which minimizes oxidation of the incoming charge. This reduces dross formation upon melting the charge and in addition provides that the charge passes through the salt layer before contacting the molten bath, with resultant cleaning of the charge of surface contaminants. The contaminants are then dispersed or dissolved in the salt rather than entering in the molten bath. The improvement in melting performance with concomitant reduction in dross formation minimizes the entrapment of unmelted charge in the dross and thereby results in improved metal recovery plus lower melt losses. The foregoing improvements are obtained when preparing ingots from both virgin elemental materials and also from finely divided scrap charges.

A particular advantage of the process of the present invention is obtained when metal scrap charges are employed. The advantages results from the high degree of reactivity with, and consequent undermining and spalling, of the surface oxides of those elements present on the charge material. The interaction and entrainment of these oxides by the molten salt layer prevents their dispersion in the melt, and thus entrainment with deleterious effects on the subsequently processed solid alloy.

In accordance with the present invention, the aforementioned advantages may be readily obtained with the use of the sodium chloride, potassium chloride mixture set forth above. In accordance with the preferred practice of the present invention, the salt mixture set forth above is added in regulated amounts to a molten metal heel, which may consist of the pure copper material or a copper base alloy depending upon the requirements of the particular material to be cast. The scrap or elemental alloying ingredients are charged to the furnace through the molten salt, thereby melting the charge. Throughout the foregoing cycle the molten salt should cover the molten metal mass in an essentially continuous flux layer and should possess reasonable fluidity. At the end of the melting procedure, the flux material may be readily skimmed from the top of the molten metal mass. This is particularly significant if skimming is the desired procedure. Naturally, one may tap off the molten metal, if desired.

In accordance with the present invention one utilizes from 0.1 to 3 lbs. of flux material per 100 lbs. of charge to be melted. In addition, the flux should have a melting point of from 660°to 800° C. In the preferred embodiment from 0.5 to 1.5 lbs. of flux are employed per 100 lbs. of metal charge with the preferred melting point of the flux being from 660°to 750° C corresponding to the preferred mixtures using 30–70% of each component. It has been found that the foregoing parameters provide an adequate amount of flux cover having sufficient fluidity to enhance melting of the charge. In addition, at the end of the melting procedure the cover may be readily skimmed from the surface of the molten material, if desired, including entrained dross, foreign material, dirt, and oxide films. It is particularly preferred to utilize a eutectic mixture of approximately 50% potassium chloride and 50% sodium chloride having a melting point of 660° C.

Flux mixtures outside the foregoing ranges have been found to give either ineffective melting, become spent part way through the melting process or make skimming difficult. Salt materials with a melting range greater than 800° C impair melting towards the end of the process, particularly as the melt surface approaches the furnace lip. The cooling effect of exhaust air freezes these high melting point mixtures and thereby retards melting and prohibits skimming.

Salt formulations with lower melting points than provided herein are known in the art. These formulations may include substantial quantities of other salts, such as lithium chloride, zinc chloride, aluminum chloride, barium chloride, etc. Additions of these materials generally increase cost and impair safety of the operation. Additives such as described above may readily combine with water vapor present in the furnace atmosphere to form hydrogen chloride fumes. Barium chloride fumes are undesirable because of their adverse effect on the nervous system of the operators. Accordingly, it is a particular advantage of the process of the present invention that significantly improved results may be obtained utilizing less than 5% by weight of other materials.

Naturally, some variability can be expected in the process of the present invention due to differences in particular furnace characteristics used, charge make-up, etc. It is particularly desirable in accordance with the present invention to add a flocullant, such as vermiculite, to the flux material at the end of melting, in order to improve ease of skimming, particularly after removal of a portion of the flux material at the end of the melting procedure.

Thus, in accordance with the process of the present invention significant advantages may be provided in the melting of copper base alloys containing from 2 to 12% aluminum. The salt flux mixture utilized in the process of the present invention is particularly suited to the foregoing alloys. The melting point of the salt mixtures is particularly effective in connection with the characteristics of these alloys so that it remains molten throughout the melting process but does not exhibit excessive fuming. The process of the present invention is particularly beneficial when large volumes of very fine scrap are to be remelted. It should be particularly noted that the benefits of the present invention are obtained through the use of molten halides which have no deleterious effects on the normal high alumina furnace refractories.

The foregoing advantages of the present invention will be more readily apparent from a consideration of the following illustrative examples.

EXAMPLE I

A 10 lb. charge of CDA Alloy 688 (23% Zn, 3.5% Al, 0.4% Co, balance Cu) fine scrap was melted in an induction furnace. After establishment of a molten heel in the bottom of the crucible, a cover of green charcoal was applied and the remaining charge fed through the cover into the heel. It was found that as melting proceeded the increased buildup of dross impaired feeding of the incoming scrap charge. Subsequently, in order that melting be completed, the charge had to be manually pushed through this charcoal-dross layer. At this point the remaining cover and dross were skimmed from the melt surface and an ingot poured. From the weights of ingot and dross recovered relative to the charge weight, it was found that a melt loss of 12% had been incurred.

EXAMPLE II

Using the same procedure as in Example I, a 10 lb. charge of CDA Alloy 688 fine scrap was melted under a molten salt flux cover consisting of equal proportions of sodium and potassium chlorides. After the establishment of a molten heel of said copper alloy and the addition of the salt flux cover, melting of additional scrap through the salt cover proceeded without the need for further manual assistance. The total amount of flux used was 0.1 lb., i.e., 1 lb, of salt per 100 lbs. of metal charge. At the end of the melting procedure the flux was skimmed from the surface of the melt, including entrained dross and the ingot was cast resulting in a metal loss of 2.5%.

EXAMPLE III

Using procedures as in Example I, a 10 lb. charge of CDA Alloy 638 (3% Al, 2% Si, 0.4% Co, balance Cu) fine scrap was melted under a conventional graphite cover. Because of the voluminous generation of dross, melting could only be completed with the aid of manual assistance, and a melt loss of 10.1% resulted.

EXAMPLE IV

The procedure of Example I was repeated using 10 lb. charge of CDA Alloy 638 melted under a molten salt cover consisting of equal proportions of sodium and potassium chloride in a manner after Example II. Melting proceeded without difficulty, the salt flux layer was removed including entrained dross and the ingot cast with a melt loss of 1.1%.

EXAMPLE V

A 10,000 lb. scrap charge of CDA Alloy 688 was prepared in a channel type induction furnace using a charcoal melt cover. The cover was applied to the 1500 lb. molten alloy heel prior to charging the scrap to the furnace. After melting the first half of the charge, melting had to be interrupted, and the large volumes of dross generated, skimmed off. On the resumption of melting, further dross was generated, and the process required constant manual assistance to ensure completion. The drosses generated consisted in large proportion of entrained, unmelted charge. Over a 500,000 lb. run, melt losses of up to 10% were experienced with this practice.

EXAMPLE VI

A 10,000 lb. charge of scrap CDA Alloy 688 was melted in a channel type induction furnace as in Example V using a molten salt cover consisting of equal proportions of sodium and potassium chloride. The salt mixture was applied, at a rate of 1 lb. per 100 lbs. of charge, to a molten heel, and the charge subsequently added to the furnace through the salt cover. Typical melt losses for a 500,000 lb. run were about 5%. In addition, the time to melt a 10,000 lb. charge was reduced to one-third of that observed with the conventional carbonaceous covers in Example V.

EXAMPLE VII

A 10,000 lb. scrap charge of CDA Alloy 688 was melted as in Example V using a molten salt cover consisting wholly of sodium chloride. The sodium chloride was applied at a rate of 1 lb. per 100 lbs. of charge, to a molten heel, and the charge subsequently added to the furnace. The charge melted without any difficulty, requiring manual assistance, in approximately one-third the time observed with conventional carbonaceous covers. However, at the completion of melting the salt cover thickened to a point where further thermal losses due to the furnace exhaust system rendered it into a hard, solid layer. This layer could only be removed with the aid of a jackhammer.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. Improved method for making copper base alloys containing from 2 to 12% aluminum which comprises:

a. providing a molten mass of a copper base alloy containing from 2 to 12% aluminum, balance copper;

b. covering the mass with an essentially continuous flux layer of molten salt consisting essentially of from 10 to 90% by weight of potassium chloride and from 10 to 90% by weight sodium chloride, said salt having a melting point of from 660° to 800° C;

c. charging additional amounts of said copper alloy to the melt through said flux layer to melt same in the molten mass; and d. casting said copper base alloy to ingot, whereby the amount of dross is reduced, molten metal cleanliness is improved, metal recovery is improved and metal losses reduced.

2. A method according to claim 1, wherein said molten salt consists essentially of from 30 to 70% of each of potassium chloride and sodium chloride.

3. A method according to claim 2 wherein a heel of a molten metal mass is provided, said heel is covered with said molten salt flux cover and additional amounts of said molten copper alloy are added to said heel through said salt cover.

4. A method according to claim 2 wherein the salt cover is removed from the molten mass including entrained material from the molten mass and the molten mass is cast into an ingot.

5. A method according to claim 2 wherein said molten salt is a eutectic mixture having the composition of 50% potassium chloride and 50% sodium chloride.

6. A method according to claim 2 wherein from 0.1 to 3 pounds of salt are utilized per 100 pounds of metal charge.

7. A method according to claim 6 wherein from 0.5 to 1.5 pounds of salt are utilized per 100 pounds of metal charge.

8. A method according to claim 2 wherein said salt has a melting point of from 660° to 750° C.

9. A method according to claim 2 wherein the salt cover is removed from the molten mass at the end of melting step (c) by skimming.

10. A method according to claim 9 wherein removal of said salt is assisted by the addition of vermicullite to the flux layer at the end of melting step (c).

11. Improved method for making copper base alloys containing from 2 to 12% aluminum which comprises:

a. providing a molten mass of a copper base alloy containing from 2 to 12% aluminum, balance copper;

b. covering the mass with an essentially continuous flux layer of a molten salt consisting essentially of from 30 to 70% by weight of potassium chloride and from 30 to 70% by weight of sodium chloride, wherein said salt has a melting point of from 660° to 750° C and wherein from 0.5 to 1.5 pounds of salt are utilized per 100 pounds of metal charge;

c. charging additional amounts of said copper alloy to the melt through said flux layer to melt same in the molten mass; and d. casting said copper base alloy to ingot, whereby the amount of dross is reduced, molten metal cleanliness is improved, metal recovery is improved and metal losses reduced.

* * * * *